US006860585B2

(12) United States Patent
Serra et al.

(10) Patent No.: US 6,860,585 B2
(45) Date of Patent: Mar. 1, 2005

(54) PRINTHEAD ORIENTATION

(75) Inventors: Josep-Maria Serra, San Diego, CA (US); Yaguang Liu, San Diego, CA (US); Robert Fogarty, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 91 days.

(21) Appl. No.: 10/460,276

(22) Filed: Jun. 11, 2003

(65) Prior Publication Data

US 2004/0032447 A1 Feb. 19, 2004

Related U.S. Application Data

(63) Continuation-in-part of application No. 10/222,653, filed on Aug. 15, 2002, now abandoned.

(51) Int. Cl.[7] ..... B41J 2/145
(52) U.S. Cl. ..... 347/40; 347/37; 347/12
(58) Field of Search ..... 347/12, 40, 41, 347/37, 19, 15, 43

(56) References Cited

U.S. PATENT DOCUMENTS 5,606,350 A 2/1997 Koyama
6,189,991 B1 2/2001 Wen et al.
6,341,840 B1 * 1/2002 van Doorn et al. ..... 347/41
6,533,385 B1 * 3/2003 Mackay et al. ..... 347/19

FOREIGN PATENT DOCUMENTS

| | | |
|---|---|---|
| EP | 0891869 | 1/1999 |
| EP | 1033251 | 9/2000 |
| GB | 2134045 | 8/1984 |

OTHER PUBLICATIONS

Copy of full European Search Report, European Application No. 03254845.5 mailed Dec. 15, 2003.

* cited by examiner

*Primary Examiner*—Lamson Nguyen

(57) ABSTRACT

A printer with a carriage adapted to receive a printhead capable of printing an ink at an effective nozzle density along a medium advance axis. The printhead includes a plurality of substantially parallel columnar arrays of nozzles, each columnar array having an actual nozzle density along the medium advance axis less than the effective nozzle density. An alignment structure in the carriage orients the printhead to print at the actual nozzle density along the medium advance axis such that individual nozzles in different ones of the columnar arrays can deposit ink on a print medium in a row substantially orthogonal to the medium advance axis.

48 Claims, 17 Drawing Sheets

⊗ DROPS FROM EVEN COLUMN

○ DROPS FROM ODD COLUMN

⊗ DROPS FROM EVEN COLUMN

○ DROPS FROM ODD COLUMN

⊗ DROPS FROM EVEN COLUMN

○ DROPS FROM ODD COLUMN

⊗ DROPS FROM EVEN COLUMN

○ DROPS FROM ODD COLUMN

⊗ DROPS FROM EVEN COLUMN

○ DROPS FROM ODD COLUMN

○ DROPS FROM 1ST COLUMN
⊗ DROPS FROM 2ND COLUMN
◬ DROPS FROM 3RD COLUMN

| Resolution | Nozzle alignment | Vertical offset | Slant in arc angle | Slant in degree | Nozzle distance (horizontal) | Print speed(ips) | Time between nozzles |
|---|---|---|---|---|---|---|---|
| 300 300 | 2 & 5 | 6 | 0.06241881 | 3.576334436 | 0.000207928 | 80 | 2.5991E-06 |
| 200 300 | 2 & 7 | 8 | 0.083141232 | 4.763641772 | 0.000276818 | 120 | 2.30682E-06 |
| 150 300 | 2 & 9 | 10 | 0.10379234 | 5.946863155 | 0.000345354 | 160 | 2.15846E-06 |
| 150 300 | 2 & 11 | 12 | 0.124354995 | 7.12501647 | 0.000413449 | 160 | 2.58406E-06 |
| 600 600 | 2 & (1,3 middle) | 3 | 0.031239833 | 1.789910639 | 0.000104116 | 20 | 5.20579E-06 |
| 300 600 | 2 & (1,3 middle) | 3 | 0.031239833 | 1.789910639 | 0.000104116 | 40 | 2.6029E-06 |

Figure 17

PRINTHEAD ORIENTATION

CROSS REFERENCE TO RELATED APPLICATIONS

This application is a continuation-in-part of the now abandoned, U.S. application Ser. No. 10/222,653, by Serra, filed Aug. 15, 2002, titled "A Tilted Nozzle Array For Achieving Nozzle Redundancy In A Printer", which is assigned to the assignee of the present invention and is hereby incorporated by reference in its entirety.

BACKGROUND OF THE INVENTION

Inkjet printing mechanisms are used in a variety of different products, such as plotters, facsimile machines and printers, collectively referred to herein as inkjet printers. These inkjet printers contain one or more inkjet printheads, also called "pens." A printhead is fluidically coupled to a reservoir of ink. The function of the print head is to eject minute ink drops, disposed from the ink reservoir, onto a sheet of print media. To print an image, the pen is mounted to a carriage in the printer. The carriage traverses over the surface of a blank sheet of media, and the print head is controlled to eject drops of ink at appropriate times pursuant to commands from a microcomputer or other controller. The timing of the application of the ink drops corresponds to the pattern of the desired image or text to be printed.

The print head ejects the ink drops through nozzles. The particular ink ejection mechanism within the print head may take on a variety of different forms known to those skilled in the art, such as thermal print head technology. In a thermal inkjet system, a barrier layer containing ink channels and vaporization chambers is located between a nozzle orifice plate and a substrate layer. This substrate layer typically contains arrays of heater elements, such as resistors, which are selectively energized to heat ink within the vaporization chambers. Upon heating, an ink droplet is ejected from a nozzle associated with the energized resistor.

Nozzle array designs often include multiple columns of nozzles, with the nozzles in a column having a certain nozzle-to-nozzle spacing. By staggering the nozzles in different columns relative to the print media, nozzles in different columns can print on different rows of the print media, thus allowing a higher resolution image to be formed than would be possible with only a single column of nozzles with that nozzle-to-nozzle spacing.

In some applications, high printing speed may be more important than high image resolution. However, it may be difficult to achieve a desired high printing speed because the printing speed is typically limited by, among other factors, the frequency at which drops can be ejected from a given nozzle.

For these and other reasons, there is a need for the present invention.

SUMMARY OF THE INVENTION

A printer with a carriage adapted to receive a printhead capable of printing an ink at an effective nozzle density along a medium advance axis is disclosed. The printhead includes a plurality of substantially parallel columnar arrays of nozzles, each columnar array has an actual nozzle density along the medium advance axis which is less than the effective nozzle density. An alignment structure in the carriage orients the printhead to print at the actual nozzle density along the medium advance axis such that individual nozzles in different ones of the columnar arrays can deposit ink on a print medium in a row substantially orthogonal to the medium advance axis.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 17 shows a tabular comparison between the normal print mode verses the print mode according to various embodiments of the present invention.

DETAILED DESCRIPTION

The present invention relates to an inkjet printer having a printhead with a nozzle array that is tilted relative to the print medium in order to achieve nozzle redundancy. The nozzles are tilted with respect to the motion of the printhead and the print medium to such a degree as to enable drops from nozzles in different columns to be printed on the same row of a print medium during a single printing pass of the printhead. Tilting the nozzle array relative to the print medium enables the same inkjet pen to be compatible for usage in many different inkjet printer models. Furthermore, greater flexibility in a printer is attained by virtue of having the option of selectively either tilting or not tilting the nozzle array. Depending on the user's dictates, the nozzle array can be tilted by varying degrees to improve speed, reliability, and/or resolution; or not tilted for better print quality. In the following detailed description of the present invention, numerous specific details are set forth in order to provide a thorough understanding of the present invention. However, the present invention may be practiced without these specific details or by using alternate elements or methods. In other instances well known methods, procedures, components, and circuits have not been described in detail as not to unnecessarily obscure aspects of the present invention.

Figure 1:
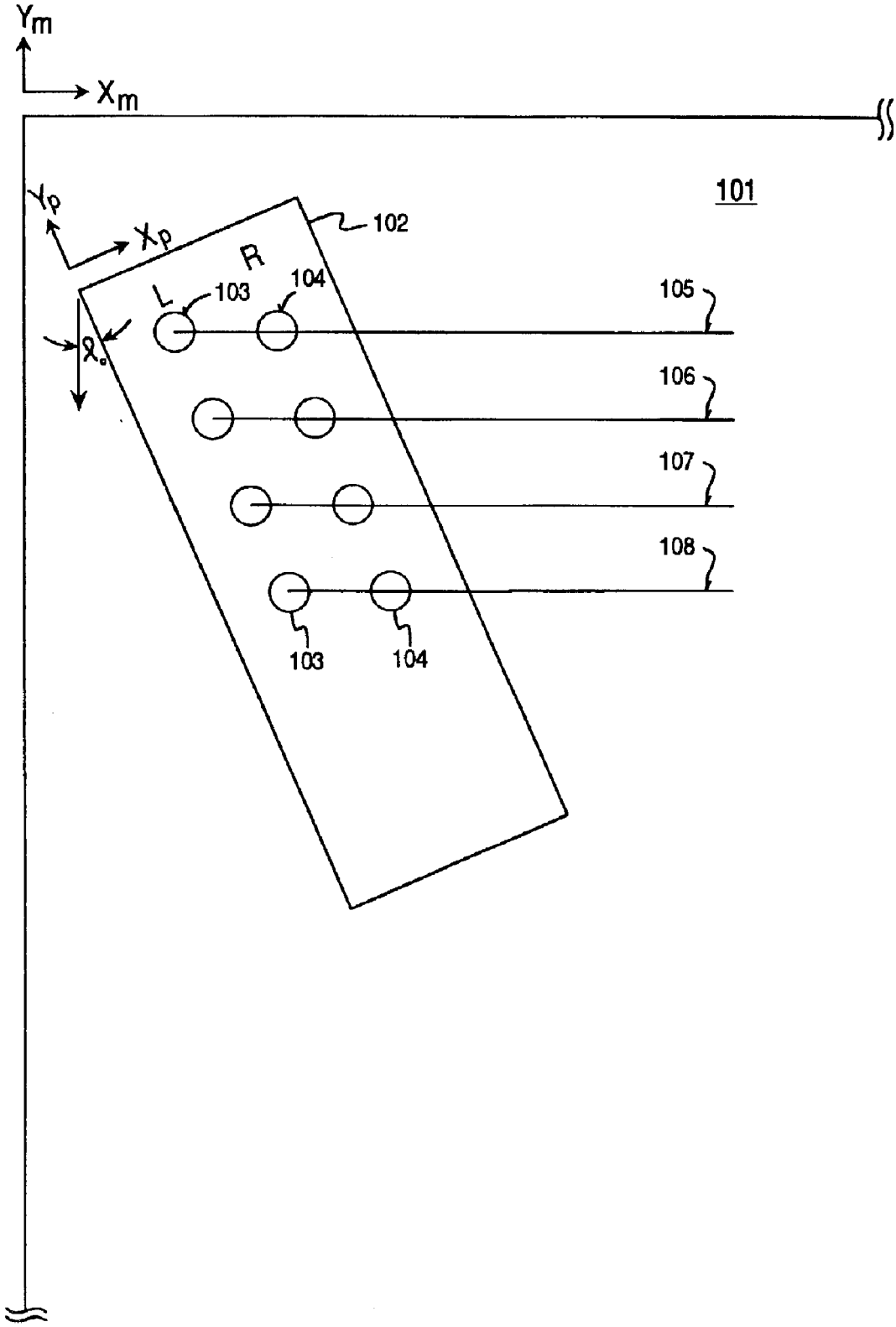
FIG. 1 shows an inkjet print head having a staggered nozzle array which is tilted relative to the print medium according to an embodiment of the present invention.

FIG. 1 shows one embodiment of the present invention of an inkjet print head having a staggered nozzle array which is tilted relative to the print medium. An inkjet print head 102 contains two columns of nozzles. The left column of nozzles 103 is adjacent to and parallel with the right column of nozzles 104. Each nozzle in the left column is staggered along the column axis with respect to a nozzle in the right column relative to the print head 102.

When installed in a printer, the print head 102 is tilted relative to the print medium 101. Instead of having the same X and Y axes as the print medium 101, the X-axis Xp of print head 102 is tilted at an angle ($\alpha$) relative to the X-axis Xm of the print medium 101. In other words, the print medium 101 has a different X-axis and different Y-axis than the X-axis and Y-axis of print head 102. The goal of this particular embodiment is to tilt print head 102 such that the columns of nozzles of this otherwise staggered nozzle array configuration align vertically relative to the print medium 101 when installed in the printer. In one embodiment, the degree of tilt is approximately two degrees. The reason for this relatively small degree of tilt is because the nozzles are extremely small and are closely spaced together. As a result, a small degree of tilt can produce a rather substantial degree of vertical separation.

By tilting the print head 102 relative to the print medium 101, the nozzles of the left column can be vertically aligned with the nozzles of the right column. In other words, each nozzle in the left column 103 has a corresponding nozzle in the right column 104 which also corresponds to that same X-axis Xm of the print medium. It can be seen that each of the rows 105–107 on the print medium 101 has a corresponding set of two nozzles for ejecting ink onto those respective rows. This nozzle redundancy design is advantageous because if one nozzle were to misfire, clog, or otherwise malfunction, the other nozzle would be available to fire in its place because it is located in the same horizontal position. For example, if one of the nozzles in the right column were to malfunction, the corresponding nozzle in the left column would be able to fire on that same line. Although in some situations this may lead to a slight degradation of the image quality, it nonetheless, is much better than having no functioning nozzles available to print on the row. For instance, rather than missing data for an entire line, the line with the defective nozzle might appear slightly lighter in color. The resultant printout may nonetheless be acceptable to the end user. Otherwise, a malfunctioning nozzle might result in unacceptable print quality. The end user would be forced under those circumstances to replace a relatively expensive cartridge.

Besides offering greater reliability, in another embodiment this design enables faster printing because the firing frequency of the system may essentially be doubled by virtue of having two columns of arrays which can be independently fired. Consequently, tilting this type of nozzle array configuration results in faster and more reliable printing. In yet another embodiment, having two nozzles on the same axis enables the inkjet printer to fire both nozzles on the same paper location in order to increase the spot size. Increasing the spot size is of great significance because a bigger spot appears to be much darker in color. There may be instances where darker colors produces greater contrasts, which leads to sharper, enhanced print quality.

Furthermore, print head 102 can be installed in a non-tilted mode into one inkjet printer model for producing a staggered nozzle output (e.g., for greater resolution in the y-direction Ym of the medium 101). Alternatively, the same print head 102 can be installed in a tilted mode for producing nozzle redundancy in a different inkjet printer model (e.g., for faster printing and/or more reliable printing). This enables the same inkjet cartridge containing the printhead to be used in different inkjet printer types that provide different orientations of the printhead with respect to the print medium. Those inkjet printer models which emphasize image quality and speed can now use the same inkjet cartridge as the inkjet printer models which emphasize improved resolution. Thereby, manufacturers can save production and inventory costs by reducing the number of different types of cartridges needed for supporting the various inkjet printer models. Further, reducing the number of different types of inkjet print cartridges available can reduce consumer confusion.

In yet a further embodiment, a given print head can be oriented in an inkjet printer model in either a non-tilted mode to achieve one set of performance criteria (e.g., greater resolution), or in a tilted mode to achieve a different set of performance criteria (e.g., faster and/or more reliable printing). This confers greater flexibility and versatility to that particular inkjet printer model. It effectively enhances the overall functionality of that inkjet printer. Thereby, that inkjet printer may offer a competitive advantage over other inkjet printers which can orient the printhead in only a single configuration.

Figure 2:
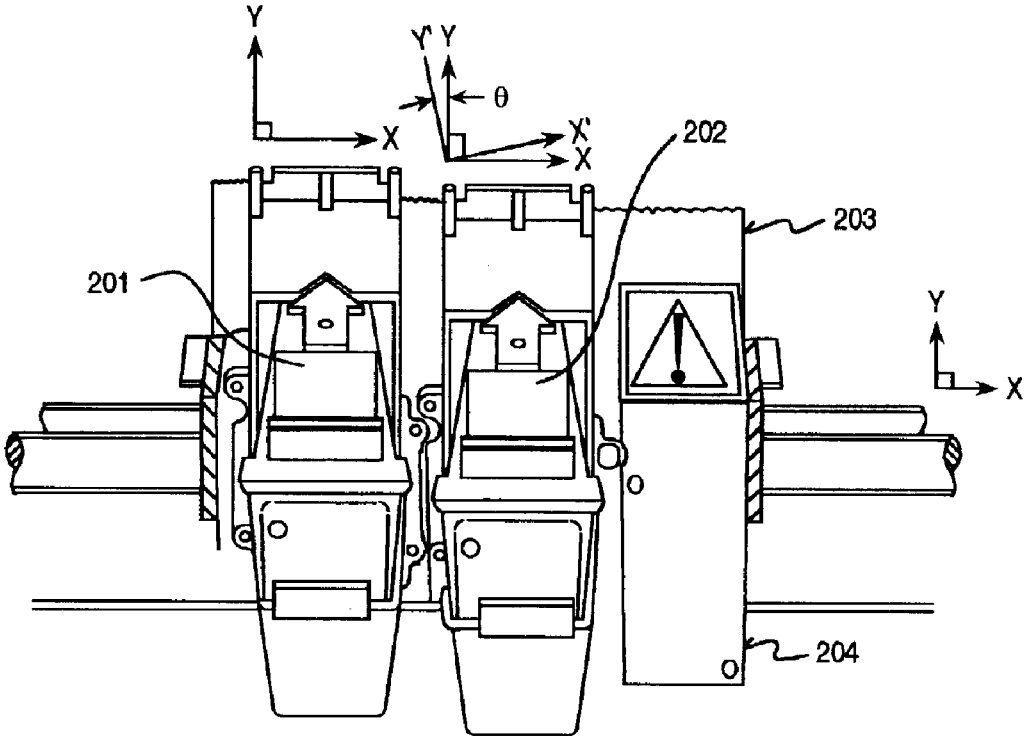
FIG. 2 shows an inkjet printer having two separate cartridges according to an embodiment of the present invention.

In one embodiment, two separate cartridges are incorporated into a single inkjet printer. FIG. 2 shows an inkjet printer having two separate inkjet printhead cartridges 201 and 202. Both cartridges 201 and 202 reside on carriage 203. The cartridges 201 and 202 are scanned across the print medium, typically in the X direction, while laying down a swath of ink. Cartridges 201 and 202 can have the same nozzle array configuration. However, one of the cartridges is oriented in a conventional non-tilted mode, while the other cartridge is oriented in a tilted mode. For example, the axes of cartridge 201 can be aligned with the paper (i.e., cartridge 201 has the same X and Y axes as that of the blank sheet of paper). In contrast, the axes of cartridge 202 can be tilted relative to the paper (i.e., cartridge 202 has X' and Y' axes which are offset from the paper's X and Y axes).

As depicted in FIG. 2, cartridge 202 is tilted by a small angle. In one embodiment, the angle may be approximately two degrees. By implementing both tilted and non-tilted modes of operation, one can selectively choose between printing for higher resolution or printing for speed and reliability. Assuming that both cartridges 201 and 202 have the same staggered nozzle array configuration, the non-tilted cartridge 201 is used for printing images at greater resolution, whereas the tilted cartridge 202 is used for faster, more reliable printing. Switching between the two cartridges can be selected by the inkjet's micro-controller or an embedded processor.

Furthermore, in one embodiment, a drop detector 204 detects a failure of one or more nozzles and provides feedback to the printer for automatically switching to a functioning nozzle. Without detection of and compensation for a malfunctioning nozzle, lines associated with malfunctioning nozzles might not be printed, or might be printed with only a portion of the ink intended to be deposited. As a result, these lines would appear lighter in color or would be unprinted. Therefore, having this malfunctioning nozzle compensation feature provides superior image quality. With a drop detector 204, malfunctioning nozzles can be detected and identified. Based on the feedback from examining the ink being deposited, the drop detector 204 determines which nozzles (if any) are defective. The redundant nozzle belonging to the same line as that of a malfunctioning nozzle can be programmed to eject the ink that had been designated for the malfunctioning nozzle. Consequently, high print quality can be maintained despite a nozzle failure.

Figure 3:
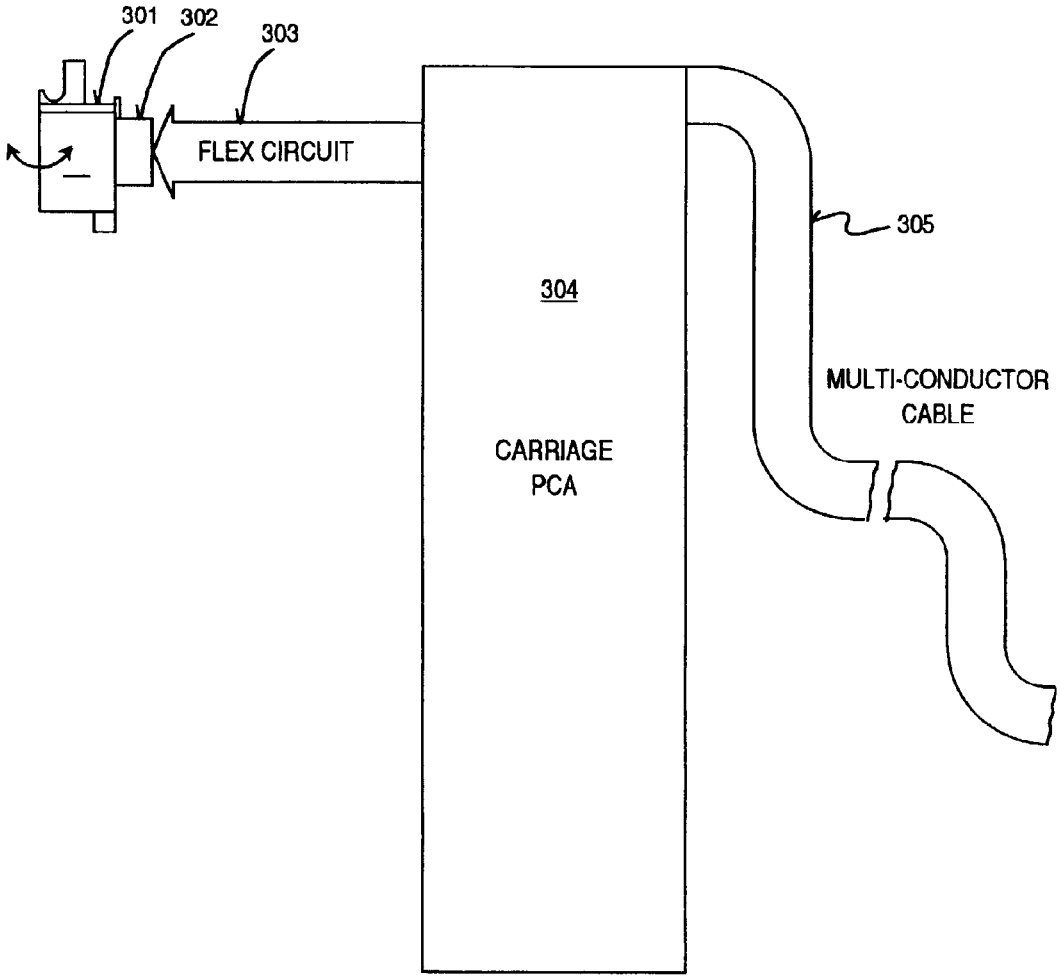
FIG. 3 shows an actuator which is used to physically rotate a cartridge such that it can be tilted relative to the print medium according to an embodiment of the present invention.

In another embodiment, a printhead can be physically rotated such that it traverses across the print medium at a selected angle. FIG. 3 shows an actuator 302 which physically rotates cartridge 301 such that it can be tilted relative to the print medium at the desired angle. Cartridge 301, containing a printhead with an array of staggered nozzles, is mechanically coupled to an actuator 302. Actuator 302 can be a motor which rotates cartridge 301. In one mode, cartridge 301 may be positioned in a non-tilted orientation at some times and in a tilted orientation at other times. A controller residing within the inkjet printer can send a command via the multi-conductor cable 305 to the carriage printed circuit assembly 304, and flex circuit 303 to cause actuator 302 to rotate cartridge 301 to a tilted orientation at angle that provides nozzle redundancy. As a result, programmatically rotating the printhead allows an individual printhead to print for either higher resolution, or for faster speed and reliability.

Figure 4:
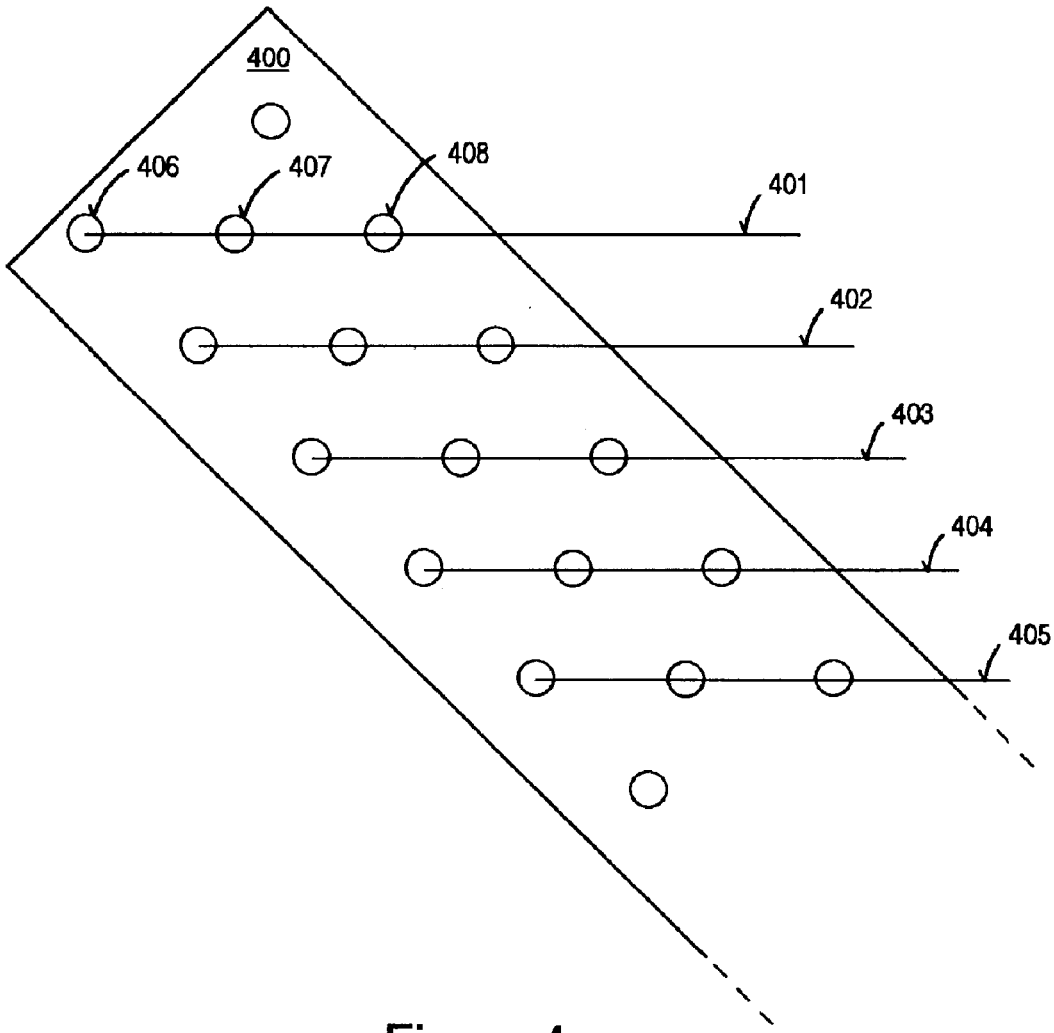
FIG. 4 shows yet another embodiment of the present invention, whereby a print head containing three or more columns of nozzles, is tilted for nozzle redundancy.

FIG. 4 shows yet another embodiment of the present invention, in which a print head 400 containing three or more columns of nozzles, is tilted for nozzle redundancy. In the illustrated embodiment, the print head 401 contains three columns of nozzles. Print head 401 is tilted relative to the print medium such that all three columns of nozzles are arranged for horizontal alignment relative to the print medium. It can be seen that row 401 has nozzles 406, 407, and 408 which can eject ink onto that particular row. Likewise, rows 402–405 have three independent nozzles which can eject ink onto those respective rows.

Figure 5:
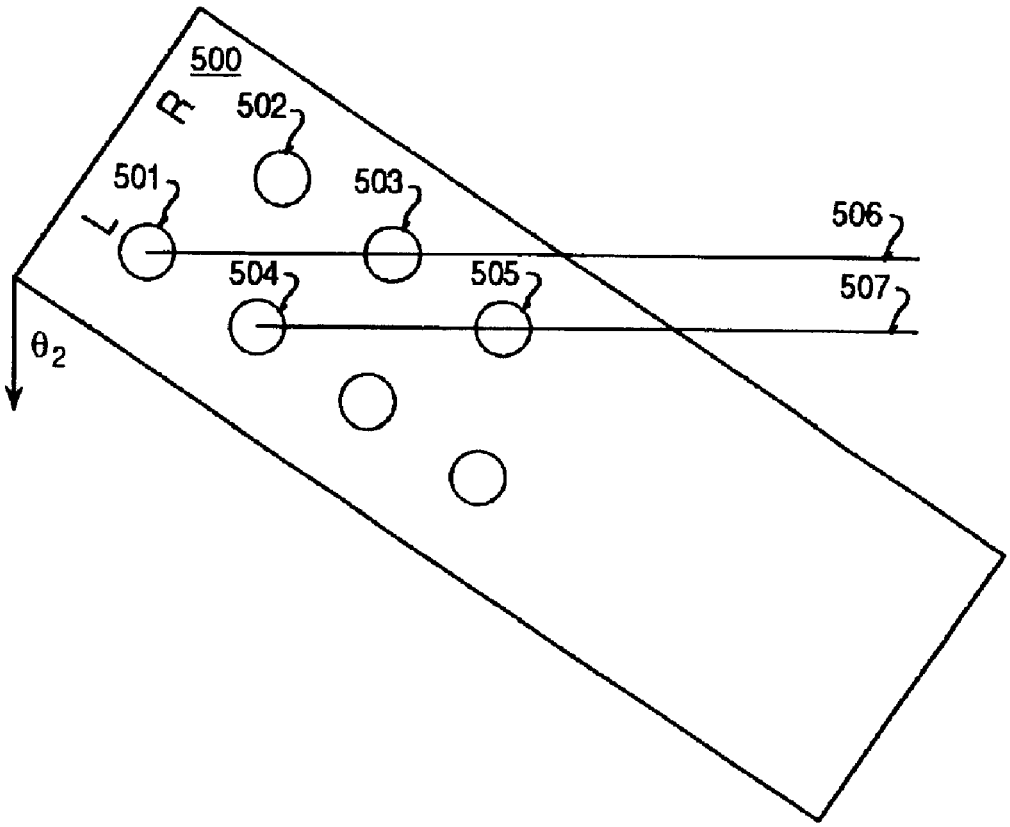
FIG. 5 shows one embodiment of the present invention where the nozzle array is tilted such that nozzle redundancy is provided between offset nozzles.

FIG. 5 shows one embodiment of the present invention where the nozzle array is tilted such that nozzle redundancy is provided between offset nozzles. Again, print head 500 includes two columns of nozzles. However, the nozzle array is tilted at a greater angle such that, for a given nozzle in the first row, nozzle redundancy is achieved by a different nozzle in the second column than illustrated in FIG. 1. The print head 500 is tilted such that the first nozzle 501 of the left column resides on the same line 506 as the second nozzle 503 of the right column. Similarly, the second nozzle 504 of the left column resides on the same line 507 as the third nozzle 505 of the right column. This embodiment may be advantageous as it provides for greater horizontal separation between the two redundant nozzles to achieve faster print speed. This concept of increasing the angle of tilt can be extended such that virtually any of the nozzles belonging to the left column can be horizontally aligned with any of the nozzles belonging to the right column.

It should be noted that the present invention is applicable to stationary inkjet printers as well as scanning inkjet printers. In a scanning inkjet printer, one or more printheads containing a tilted nozzle array is horizontally scanned across the print medium to deposit a line of ink. In a stationary inkjet printer an entire line of ink is deposited by implementing multiple printheads, at least one of which contains a tilted nozzle array. It should also be noted that any of the cartridges can be black and/ or color ink.

Figure 6:
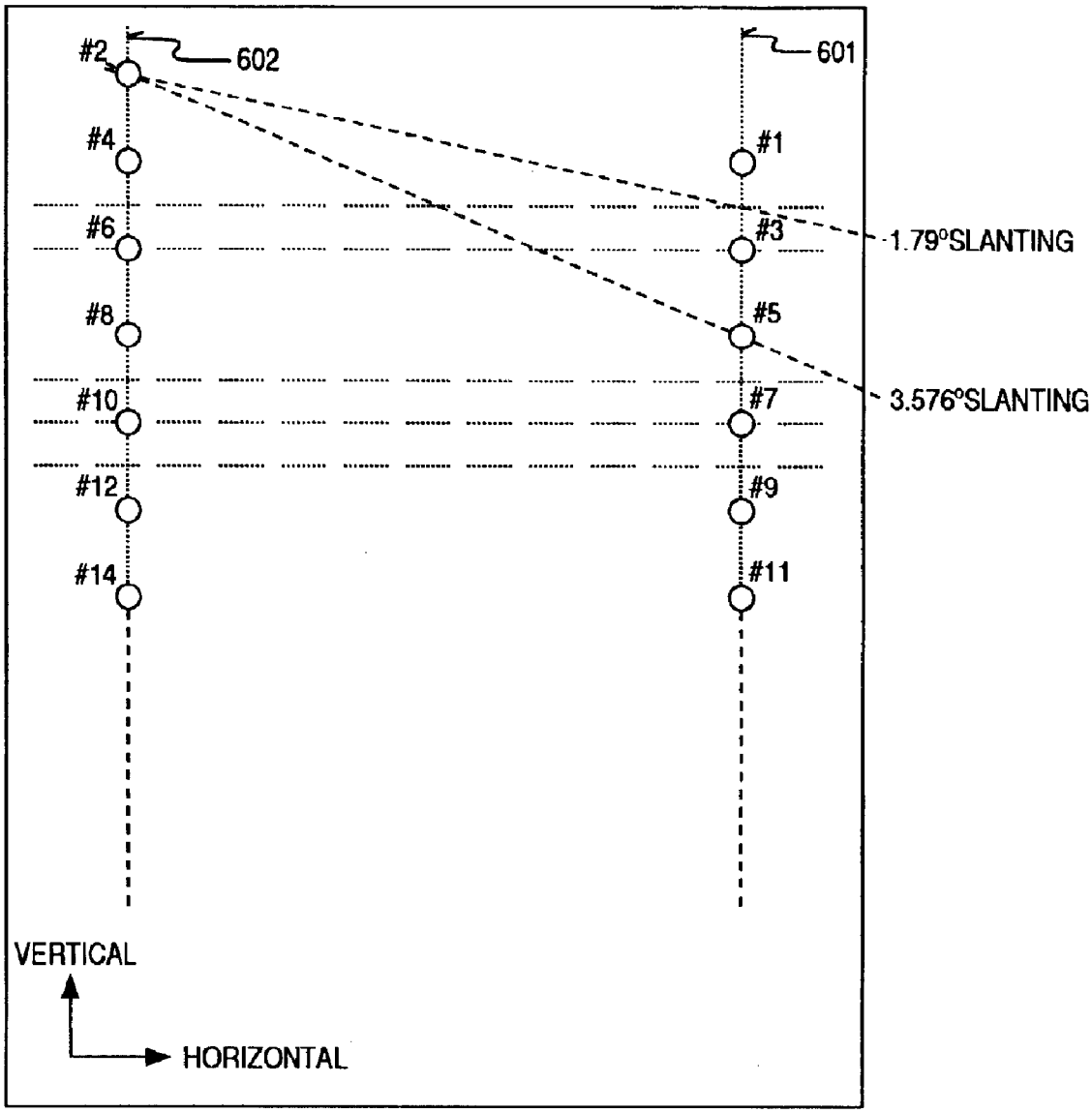
FIG. 6 shows a print head usable with an embodiment of the present invention with a maximum firing frequency having two columns of print nozzles.
Figure 7:
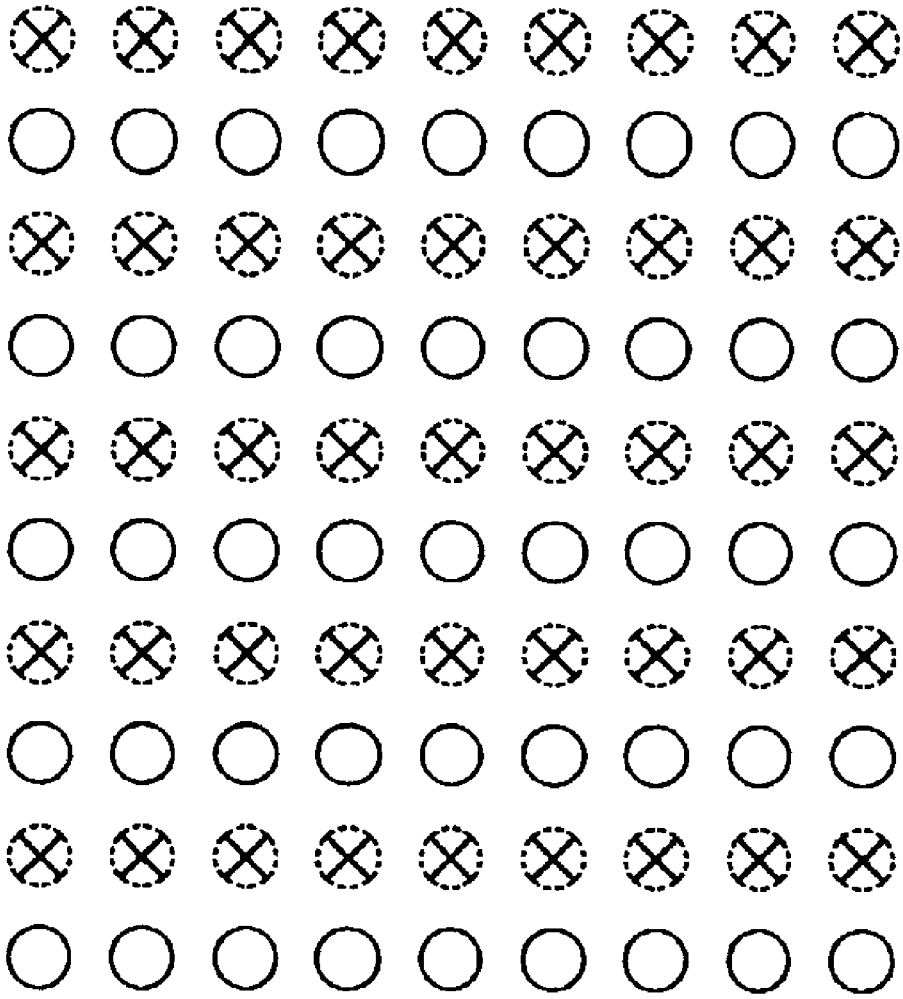
FIG. 7 shows a full black out print pattern for a 600 by 600 dpi image according to an embodiment of the present invention.
Figure 8:
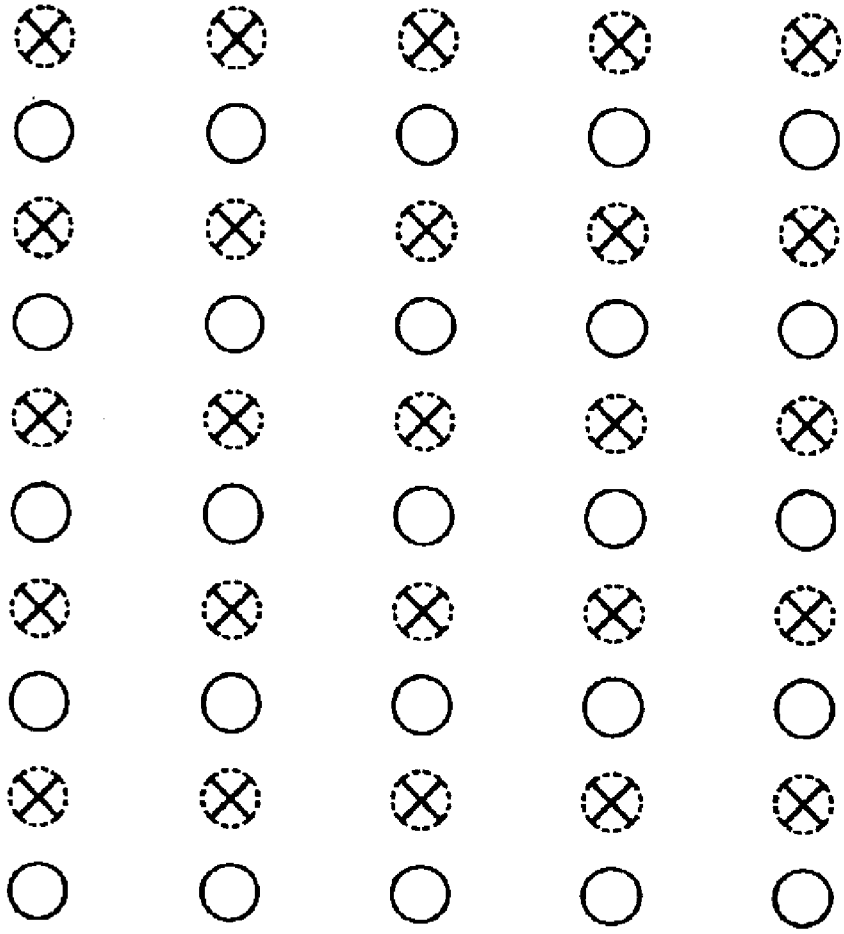
FIG. 8 shows a full black out print pattern for a 600 by 300 dpi image according to an embodiment of the present invention.

In another embodiment of the present invention, the multiple columns of nozzles in a print head are used to achieve high print speed instead of high resolution. FIG. 6 shows a print head with two columns of print nozzles (e.g., odd column and even column). The adjacent nozzles in a column are spaced 1/300 inch apart vertically. The conventional print scheme is to slant the print head 1.79 degrees, so that the odd nozzles fall in the middle of the even nozzles when the print head or media move horizontally, thus achieving an effective vertical nozzle spacing of 1/600 inch. With the conventional way of printing, for a 600 by 600 dpi image, the maximum print speed is 20 inch-per-second (ips) for a printhead with a given maximum firing frequency. The full black out print pattern for 600 by 600 printing is shown in FIG. 7. If the horizontal print resolution is decreased to 300 dpi, printing can occur at 40 ips maximum for a printhead with the same given maximum firing frequency. The corresponding full black print pattern for this 600 by 300 printing is shown in FIG. 8.

Figure 9:
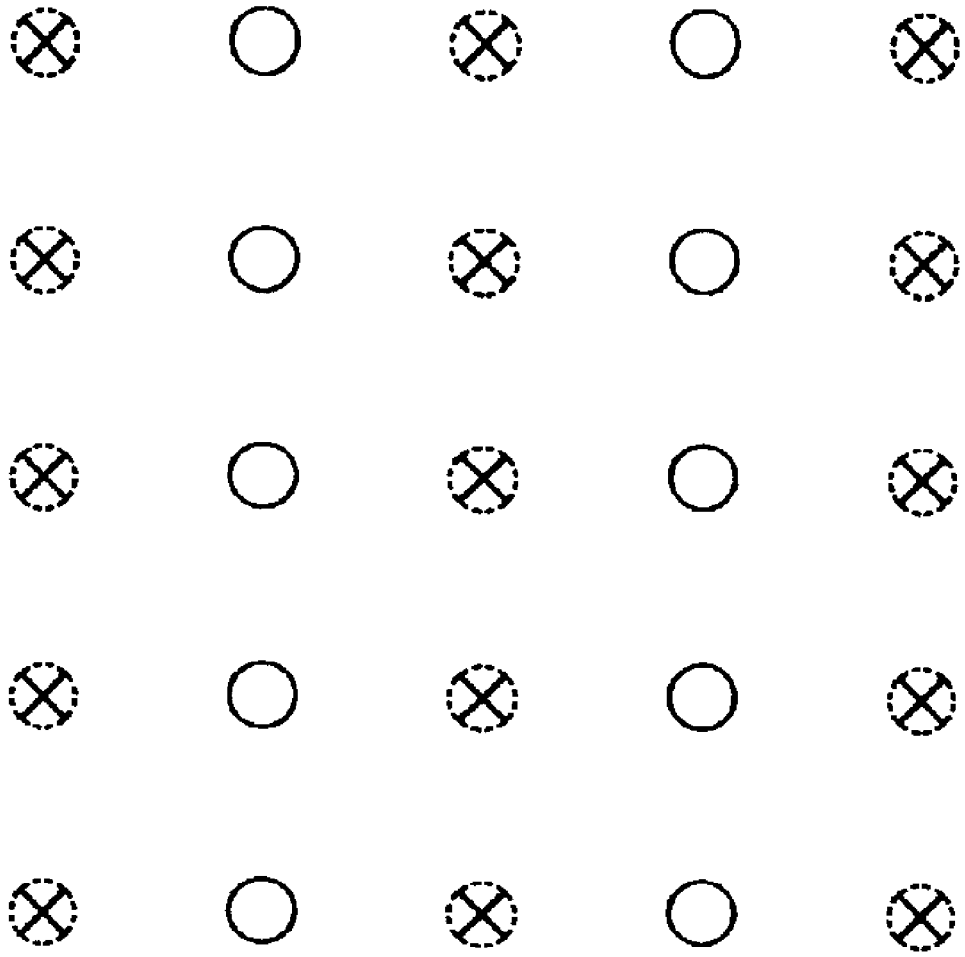
FIG. 9 shows a full black out print pattern for a 300 by 300 dpi image according to an embodiment of the present invention.

In one embodiment, the slanting is re-arranged by tilting the printhead at a different angle, so that the odd nozzles are in line with the even nozzles horizontally. One example is that nozzle 2 is aligned with the nozzle 5 horizontally, as shown in FIG. 6. The slant angle is arctan(6/96)=3.576 degree. Such an alignment results in an effective vertical nozzle spacing of 300 dpi rather than 600 dpi. The full black out print pattern for 300 by 300 dpi printing is shown in FIG. 9. Each column of nozzles only prints every other vertical line. Hence, for a printhead with the same given maximum firing frequency, printing can occur at 80 ips. Printing at or less than the maximum firing frequency ensures that there will be enough time between the adjacent nozzles to satisfy minimum fire pulse width and minimum time interval requirements. Reference is now made to U.S. Pat. No. 5,635,968, entitled "Thermal Inkjet Printer Printhead With Offset Heater Resistors," which is incorporated by reference in its entirety herewith. With 3.576 degree slanting, the horizontal distance between two nozzles is 1/300*sin(3.576)= 2.08 e−4 inch. At 80 ips, the time between two nozzles in a primitive firing for a full black out image is 2.08 e−4/80=2.6 microsecond. It is sufficient for minimum fire pulse width and time interval requirements. Since only one nozzle can be fired at a time in one primitive, the last nozzle must finish firing before the first nozzle reaches the next print column. In other words, the horizontal distance of each primitive should be less than the horizontal resolution of the image. With 300 by 300 dpi and 3.576 degree slanting, this requirement is satisfied.

Figure 10:
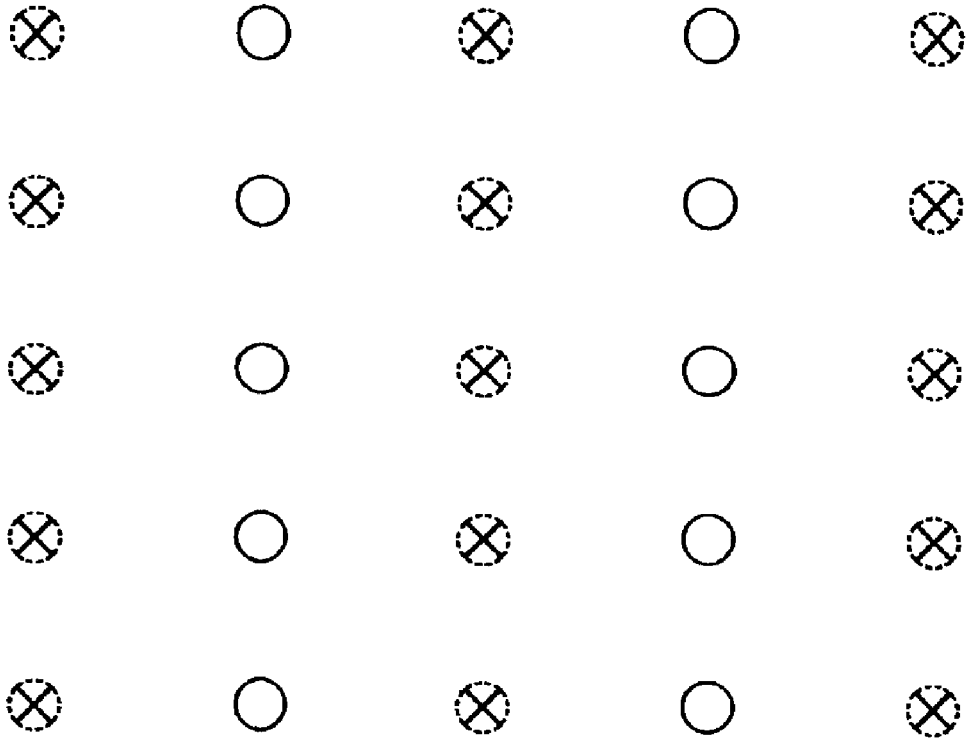
FIG. 10 shows a full black out print pattern for a 300 by 200 dpi image according to an embodiment of the present invention.
Figure 11:
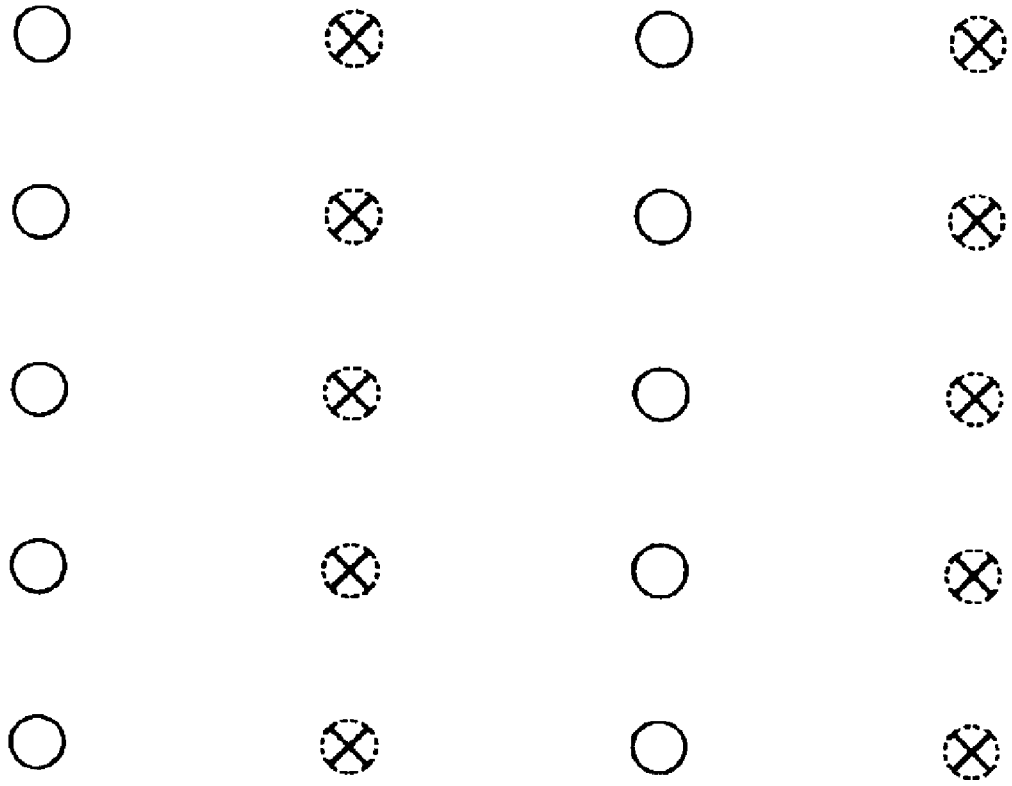
FIG. 11 shows a full black out print pattern for a 300 by 150 dpi image according to an embodiment of the present invention.

If nozzle 2 and nozzle 7 are aligned horizontally, the slanting angle is 4.764 degrees, it can print at 300 vertical by 200 horizontal dpi at 120 ips. The full black out image pattern is shown in FIG. 10. The time between two nozzles firing in a primitive for a full black out image is 2.31 microseconds. If nozzle 2 and nozzle 9 are aligned horizontally, the slanting angle is 5.947 degrees. It can print at 300 vertical by 150 horizontal dpi at 160 ips. The full black out image pattern is shown in FIG. 11. The time between two nozzles firing for a full black out image is 2.16 microseconds. If it slants more, such that nozzle 2 and nozzle 11 are aligned horizontally, the angle is 7.125 degrees. With the same print speed as 160 ips, and 300 vertical by 150 horizontal dpi resolution, the time between two nozzles firing for a full black out image is 2.58 microseconds. This grants more time margin for fire pulses. It should be noted that for all the above cases, without changing the angle of printhead rotation, if the print speed is lowered to half of its maximum, printing can occur at twice the horizontal resolution specified above. Furthermore, various embodiments can be expanded into print heads with three or more columns of nozzles. Consequently, embodiments of the present invention fully utilize the multiple columns on a print head to achieve high speed printing. The vertical resolution can be reduced, without padding zeros in the print data. In addition, more horizontal distance between adjacent nozzles can be achieved for higher speed or more time margin.

Figure 12:
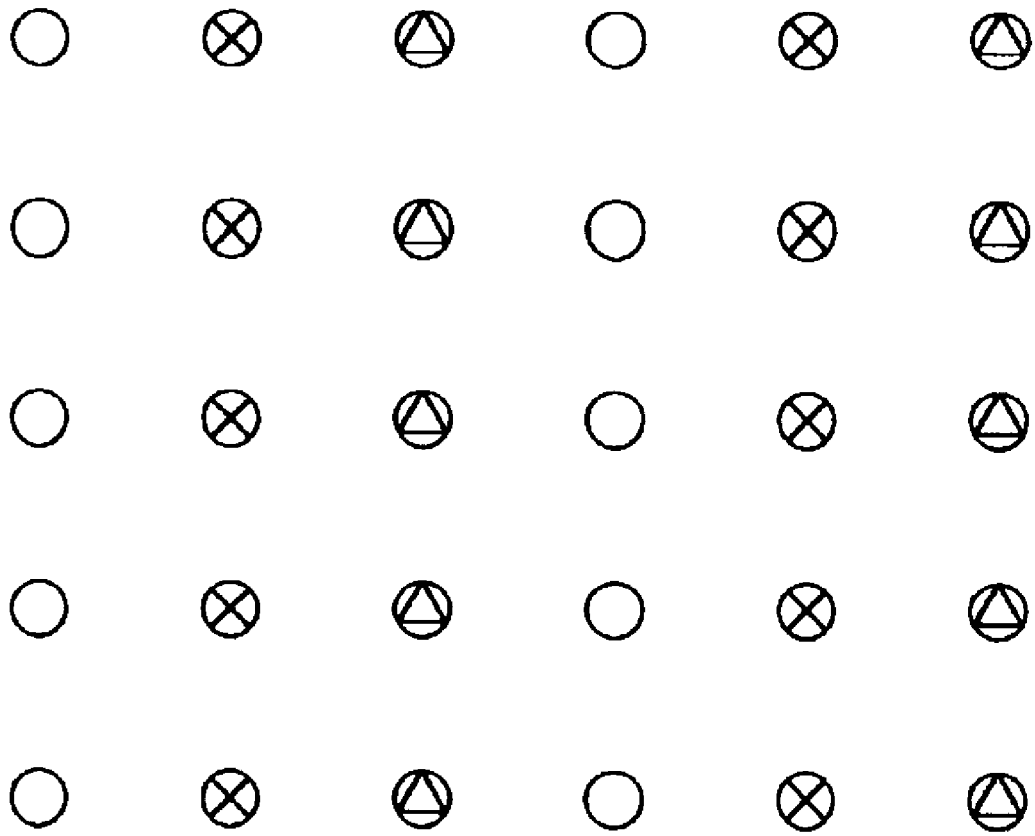
FIG. 12 shows a diagram illustrating a three-column print pattern in accordance with one embodiment of the present invention.

FIG. 12 shows a full black out image pattern for a three-column print pattern, such as the one depicted in FIG. 4.

Figure 13:
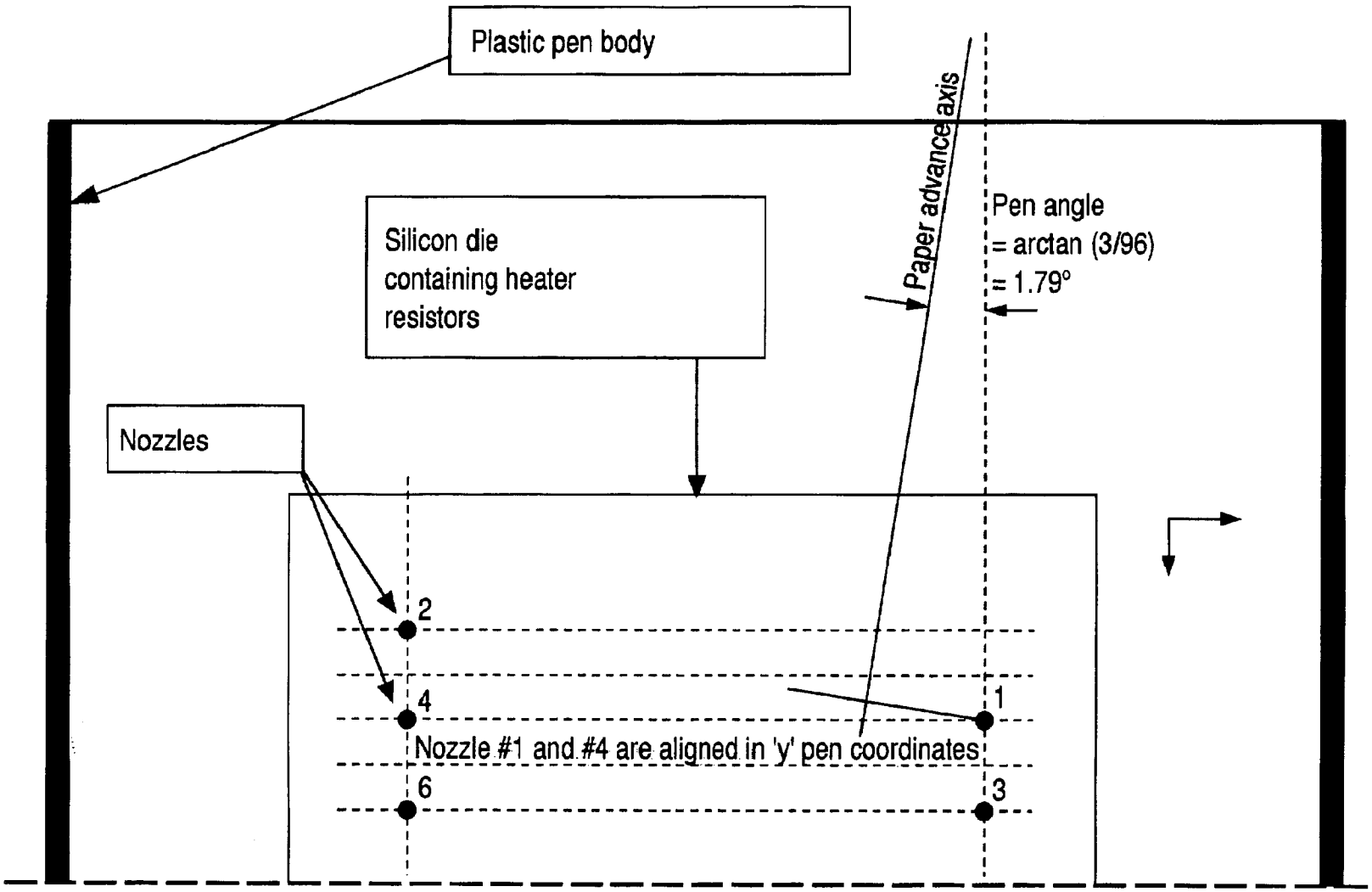
FIG. 13 shows a print head architecture according to an embodiment of the present invention whereby the printer rotates the printhead with respect to the medium advance axis.

FIG. 13 shows a print head architecture in which the printer rotates the printhead with respect to the paper axis by a small angle, rather than aligning the printhead with the pen Y axis parallel to the paper axis. In this particular embodiment, the printer rotates each pen by arctan (1/32) or 1.79 degrees. The print head is rotated 1.79 degrees relative to the paper axis for drops to land in a straight line when correct timing of the firing pulses is delivered.

Figure 14:
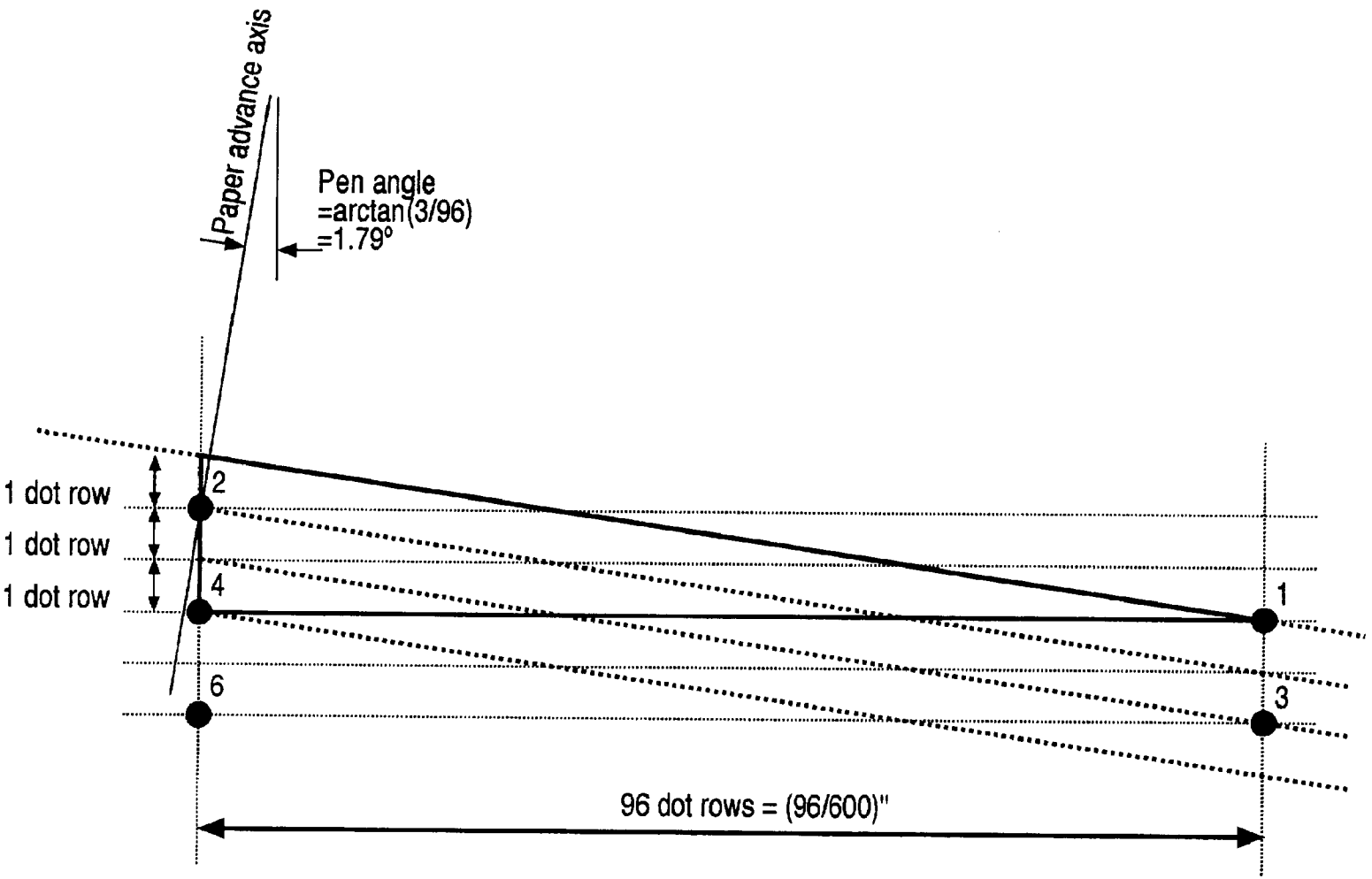
FIG. 14 shows the effect of a 1.79 degree rotation of the printhead of FIG. 13.

FIG. 14 shows the effect of printing with the 1.79 degree rotation of FIG. 13. Firing each nozzle once with the correct timing, in this geometry, results in a straight line of horizontal dots at a resolution of 600 dpi.

Figure 15:
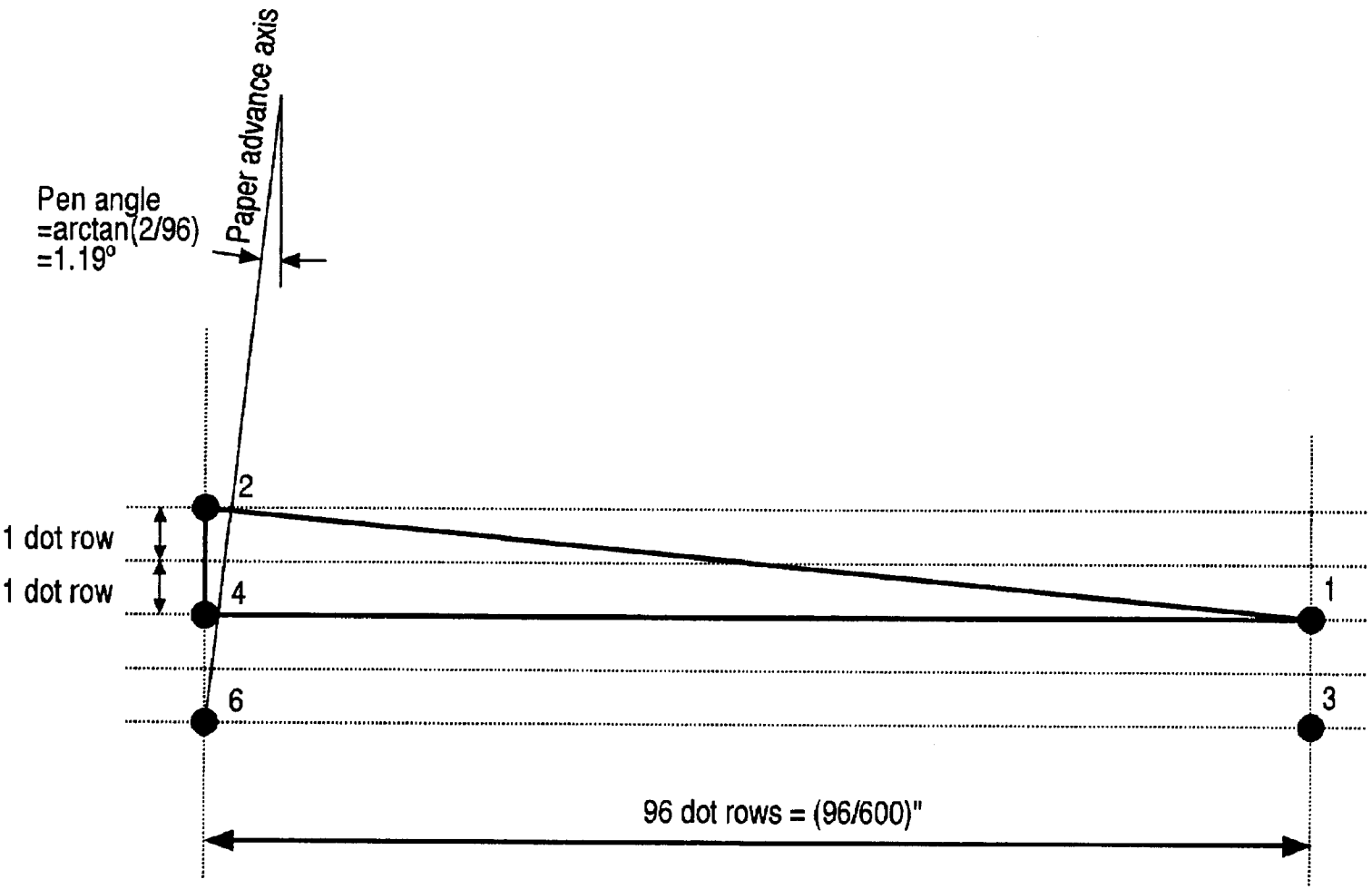
FIG. 15 shows the effect of a 1.19 degree rotation of the printhead of FIG. 13.

FIG. 15 shows the effect of printing with a 1.19 degree default rotation instead of a 1.79 degree rotation. Firing each nozzle once with the correct timing, in this geometry, results in a straight line of horizontal dots at a resolution of 300 dpi with drops from odd-numbered nozzles landing approximately on the same locations as, and overlaying, the even-numbered drops.

Figure 16:
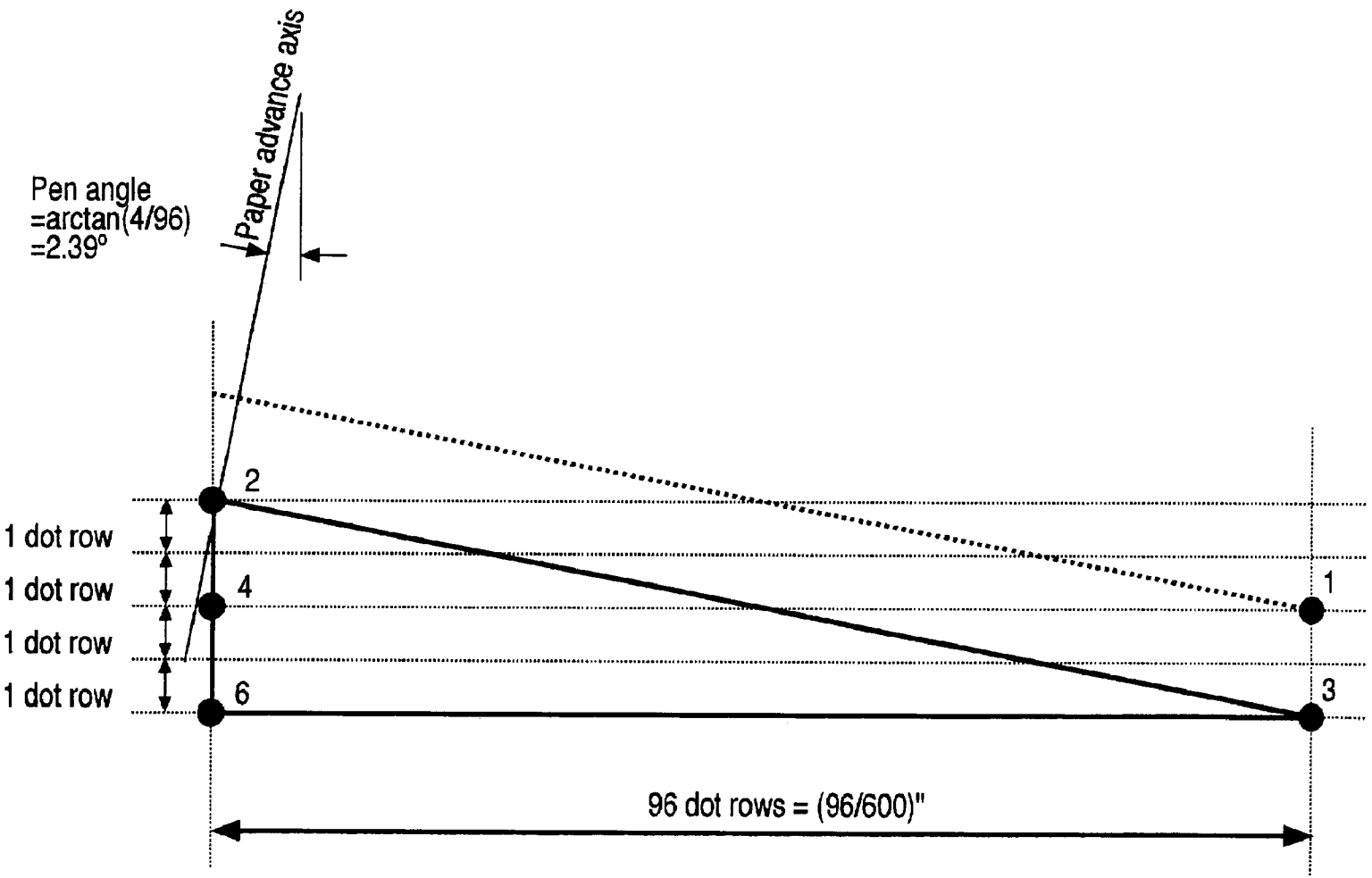
FIG. 16 shows the effect of a 2.39 degree rotation of the printhead of FIG. 13.

FIG. 16 shows the sense of the rotation, viewing the printer from above, corresponding to a 2.39 degree default rotation. Firing each nozzle once with the correct timing, in this geometry, results in a horizontal straight line at a resolution of 300 dpi with odd drops landing approximately on the same locations as, and overlaying, the even-numbered drops (except for the first and last drops).

FIG. 17 shows a tabular comparison between non-redundant print modes and redundant print modes according to various embodiments of the present invention. The last two rows correspond to non-redundant print modes, whereas the first four rows correspond to the various redundant printmode embodiments of the present invention.

Therefore, the embodiments of the present invention, an inkjet printer having a print head with a nozzle array which is tilted relative to the print medium, has been described. While the present invention has been described in particular embodiments, it should be appreciated that the present invention should not be construed as limited by such embodiments, but rather construed according to the below claims.

What is claimed is:

1. A printer, comprising:

a carriage adapted to receive a printhead capable of printing an ink at an effective nozzle density along a medium advance axis, the printhead having a plurality of substantially parallel columnar arrays of nozzles, each columnar array having an actual nozzle density along the medium advance axis less than the effective nozzle density; and an alignment structure in the carriage that orients the printhead to print at the actual nozzle density along the medium advance axis such that individual nozzles in different ones of the columnar arrays can deposit ink on a print medium in a row substantially orthogonal to the medium advance axis.

2. The printer of claim 1, wherein said ink comprises a single-color ink.

3. The printer of claim 1, wherein the carriage transports the printhead along a scan axis substantially orthogonal to the medium advance axis during printing.

4. The printer of claim 1, wherein at least two nozzles are fired to increase spot size.

5. A printer for printing rows and columns of a print medium, comprising:

a carriage adapted to receive a printhead having a plurality of substantially parallel columnar arrays of nozzles, the carriage further adapted to traverse a scan axis parallel to the rows during a printing pass; and an alignment structure in the carriage that orients the printhead with respect to the scan axis such that each of the columns is printed by the nozzles of a single columnar array and different columns are printed by the nozzles of different columnar arrays during the printing pass.

6. The printer of claim 5, wherein the nozzles in each columnar array are staggered along a column axis relative to the nozzles in at least one other columnar array.

7. A printer, comprising:

a carriage adapted to receive a printhead having a plurality of substantially parallel columnar arrays of nozzles, the carriage further adapted to traverse a scan axis during printing; and an alignment structure in the carriage that angles the printhead with respect to the scan axis such that at least some of the nozzles in at least two of the columnar arrays are aligned along a printing axis substantially parallel to the scan axis.

8. The printer of claim 7, wherein the nozzles in each columnar array are staggered along a column axis relative to the nozzles in at least one other columnar array.

9. The printer of claim 7, wherein the number of columns consist of two columns.

10. The printer of claim 7, wherein the number of columns consist of three columns.

11. The printer of claim 7, wherein each column axis is tilted at a predetermined angle from a media advance axis substantially orthogonal to the scan axis.

12. The printer of claim 11, wherein the predetermined angle is selected from a set of discrete angles.

13. The printer of claim 12, wherein the discrete angle is selected from a group consisting of approximately 1.19, 2.39, 2.98, 3.58, 4.76, 5.95, and 7.13 degrees.

14. A printer, comprising:

a printhead having a plurality of substantially parallel columnar arrays of nozzles; and an actuator coupled to the printhead, the actuator configured to rotate the printhead between a first position in which the nozzles are arranged to print at a higher resolution along a medium advance axis, and a second position in which the nozzles are arranged to print at one of a higher speed and a higher nozzle defect tolerance.

15. The printer of claim 14 further including a print controller operably coupled to the actuator for controlling the rotation.

16. The printer of claim 15, wherein the print controller specifies an angle of rotation.

17. The printer of claim 14 further comprising a drop detector for switching printing from a malfunctioning nozzle to a functioning nozzle.

18. A printer, comprising:

a carriage adapted to receive a printhead capable of printing an ink at an effective nozzle density along a medium advance axis, the printhead having a plurality of substantially parallel columnar arrays of nozzles, each columnar array having an actual nozzle density along the medium advance axis less than the effective nozzle density; and an alignment structure in the carriage that orients the printhead to print at the actual nozzle density along the medium advance axis such that improved print speed is achieved.

19. The printer of claim 18, wherein said ink comprises a single-color ink.

20. The printer of claim 18, wherein the carriage transports the printhead along a scan axis substantially orthogonal to the medium advance axis during printing.

21. The printer of claim 18, wherein at least two nozzles are fired to increase spot size.

22. The printer of claim 18, wherein the nozzles in each columnar array are staggered along a column axis relative to the nozzles in at least one other columnar array.

23. The printer of claim 22, wherein each column axis is tilted at a predetermined angle from the media advance axis, the predetermined angle comprising one of 1.19, 2.39, 2.98, 3.58, 4.76, 5.95, and 7.13 degrees.

24. The printer of claim 18, wherein said printhead comprises a fixed, non-scanning printhead application.

25. A method for printing, comprising:

providing a printhead capable of printing an ink at an effective nozzle density along a medium advance axis, the printhead having a plurality of substantially parallel columnar arrays of nozzles, each columnar array having an actual nozzle density along the medium advance axis less than the effective nozzle density; and orienting the printhead to print at the actual nozzle density along the medium advance axis such that individual nozzles in different ones of the columnar arrays can deposit ink on a print medium in a row substantially orthogonal to the medium advance axis.

26. The method of claim 25, wherein said ink comprises a single-color ink.

27. The method of claim 25, wherein the printhead is transported along a scan axis substantially orthogonal to the medium advance axis during printing.

28. The method of claim 25, wherein at least two nozzles are fired to increase spot size.

29. A method for printing rows and columns of a print medium, comprising:

providing a printhead having a plurality of substantially parallel columnar arrays of nozzles, the printhead adapted to traverse a scan axis parallel to the rows during a printing pass; and orienting the printhead with respect to the scan axis such that each of the columns is printed by the nozzles of a single columnar array and different columns are printed by the nozzles of different columnar arrays during the printing pass.

30. The method of claim 29 further comprising the step of, staggering the nozzles in each columnar array along a column axis relative to the nozzles in at least one other columnar array.

31. A method for printing, comprising:

providing a printhead having a plurality of substantially parallel columnar arrays of nozzles, the printhead adapted to traverse a scan axis during printing; and angling the printhead with respect to the scan axis such that at least some of the nozzles in at least two of the columnar arrays are aligned along a printing axis substantially parallel to the scan axis.

32. The method of claim 31 further comprising the step of staggering the nozzles in each columnar array along a column axis relative to the nozzles in at least one other columnar array.

33. The method of claim 31, wherein the number of columns consist of two columns.

34. The method of claim 31, wherein the number of columns consist of three columns.

35. The method of claim 31, wherein each column axis is tilted at a predetermined angle from a media advance axis substantially orthogonal to the scan axis.

36. The printer of claim 31, wherein the predetermined angle is selected from a set of discrete angles.

37. A computer-readable medium having stored thereon instructions for:

configuring a printer to rotate a printhead to a first position in which a plurality of substantially parallel columnar arrays of nozzles are arranged to print at a higher resolution along a medium advance axis; and configuring the printer to rotate the printhead to a second position in which the nozzles are arranged to print at one of a higher speed and a higher nozzle defect tolerance.

38. The computer-readable medium of claim 37 further comprising instructions for controlling the rotation of an actuator which controls the rotation of the printhead.

39. The computer-readable medium of claim 38 further comprising instructions for rotating the printhead as specific pre-determined angles of rotation.

40. The computer-readable medium of claim 39, wherein the angles of rotation comprise one of 1.19, 2.39, 2.98, 3.58, 4.76, 5.95, and 7.13 degrees.

41. A printer comprising:

means for receiving a printhead capable of printing an ink at an effective nozzle density along a medium advance axis, the printhead having a plurality of substantially parallel columnar arrays of nozzles, each columnar array having an actual nozzle density along the medium advance axis less than the effective nozzle density; and means for orienting the printhead to print at the actual nozzle density along the medium advance axis such that individual nozzles in different ones of the columnar arrays can deposit ink in a row substantially orthogonal to the medium advance axis.

42. A printer for printing rows and columns of a print medium, comprising:

means for receiving a printhead having a plurality of substantially parallel columnar arrays of nozzles, the carriage further adapted to traverse a scan axis parallel to the rows during a printing pass; and means for orienting the printhead such that each of the columns is printed by the nozzles of a single columnar array and different columns are printed by the nozzles of different columnar arrays during the printing pass.

43. A printer, comprising:

means for receiving a printhead having a plurality of substantially parallel columnar arrays of nozzles, the carriage further adapted to traverse a scan axis during printing; and means for angling the printhead with respect to the scan axis such that at least some of the nozzles in at least two of the columnar arrays are aligned along a printing axis substantially parallel to the scan axis.

44. A printer, comprising:

a carriage adapted to receive a printhead capable of printing an ink at an effective nozzle density along a medium advance axis, the printhead having a plurality of substantially parallel columnar arrays of nozzles, each columnar array having an actual nozzle density along the medium advance axis less than the effective nozzle density; and an alignment structure in the carriage that orients the printhead to print at the actual nozzle density along the medium advance axis such that nozzle redundancy is achieved.

45. The printer of claim 44, wherein said ink comprises a single-color ink.

46. The printer of claim 44, wherein the carriage transports the printhead along a scan axis substantially orthogonal to the medium advance axis during printing.

47. The printer of claim 44, wherein at least two nozzles are fired to increase spot size.

48. The printer of claim 44, wherein said printhead comprises a fixed, non-scanning printhead application.

* * * * *